US006678983B2

(12) United States Patent
Jamison

(10) Patent No.: US 6,678,983 B2
(45) **Date of Patent: *Jan. 20, 2004**

(54) ULTRA-SHORT-ACTION FIREARM FOR HIGH-POWER FIREARM CARTRIDGE

(76) Inventor: John R. Jamison, 84784 Christensen Rd., Eugene, OR (US) 97405

( * ) Notice: Subject to any disclaimer, the term of this patent is extended or adjusted under 35 U.S.C. 154(b) by 0 days.

This patent is subject to a terminal disclaimer.

(21) Appl. No.: 10/372,588

(22) Filed: Feb. 21, 2003

(65) Prior Publication Data

US 2003/0136292 A1 Jul. 24, 2003

Related U.S. Application Data

(63) Continuation of application No. 10/002,360, filed on Nov. 13, 2001, now Pat. No. 6,550,174, which is a division of application No. 09/364,329, filed on Jul. 29, 1999, now Pat. No. 6,354,221, which is a continuation of application No. 09/062,448, filed on Apr. 17, 1998, now Pat. No. 5,970,879, which is a continuation-in-part of application No. 08/818,440, filed on Mar. 17, 1997, now Pat. No. 5,826,361.

(51) Int. Cl.[7] ..... F41A 3/00; F42B 5/26

(52) U.S. Cl. ..... 42/25; 42/16; 102/430; 102/464

(58) Field of Search ..... 102/430, 464–472; 42/14, 16, 25, 76.01

(56) References Cited

U.S. PATENT DOCUMENTS

| | | | |
|---|---|---|---|
| 831,132 | A | 9/1906 | Young et al. |
| 2,286,775 | A | 6/1942 | Weldin |
| 2,402,068 | A | 6/1946 | Meador |
| 2,455,080 | A | 11/1948 | Miller et al. |
| 2,464,323 | A | 3/1949 | Lee |
| 2,685,754 | A | 8/1954 | Crittendon et al. |
| 3,209,691 | A | 10/1965 | Herter |
| 3,498,221 | A | 3/1970 | Hilton et al. |
| 3,738,224 | A | 6/1973 | Post et al. |
| 3,745,924 | A | 7/1973 | Scanlon |
| 3,765,297 | A | 10/1973 | Skochko et al. |
| 3,797,396 | A | 3/1974 | Reed |
| 3,830,157 | A | 8/1974 | Donnard et al. |
| 3,846,928 | A | 11/1974 | Ruger et al. |
| 3,893,321 | A | 7/1975 | Braunwieser |
| 4,265,043 | A | 5/1981 | Rowlands |
| 4,272,902 | A | 6/1981 | Waters |
| 4,359,810 | A | 11/1982 | Osborne et al. |
| 4,457,092 | A | 7/1984 | Hupp et al. |
| 4,651,455 | A | 3/1987 | Geiser, Jr. |
| 4,920,677 | A | 5/1990 | Schuerman |
| 5,033,386 | A | 7/1991 | Vatsvog |
| 5,463,959 | A | 11/1995 | Kramer |
| 5,826,361 | A | 10/1998 | Jamison |
| 5,970,879 | A | 10/1999 | Jamison |
| 6,354,221 | B1 | 3/2002 | Jamison |

FOREIGN PATENT DOCUMENTS

| | | |
|---|---|---|
| DE | 11356 | 8/1956 |
| DE | 4108550 | 9/1992 |

OTHER PUBLICATIONS

"22PPC Cartridge," developed in 1974, described in *Rifle Reloading Data*, p. 203, date unknown.

Jamison, "Precision Reloading," *Shooting Times*, Jan., 1996.

Barnes, ".300 Savage," *Cartridges of the World*, Chicago, 1965, p. 35.

(List continued on next page.)

*Primary Examiner*—Harold J. Tudor
(74) *Attorney, Agent, or Firm*—Chernoff, Vilhauer, McClung & Stenzel

(57) ABSTRACT

A short-action firearm has a chamber and bolt assembly with unique pressure, length and diametric relationships. The overall length of the chamber has a ratio to a diameter thereof, at a predetermined location on a wide portion of the chamber, of no more than about 3.5. Such diameter is at least about 0.53 inch, and the length of the wide portion of the chamber has a ratio to such diameter of no more than about 3.

21 Claims, 4 Drawing Sheets

OTHER PUBLICATIONS

.30/.378 Arch, *Handbook for Shooters and Reloaders*, 1986, p. 442.

Jamison, Precision Reloading, *Shooting Times*, Jun. 1997, pp. 42–49, 74.

Jamison, "Precision Reloading," *Shooting Times*, Oct., 1996, p. 34.

Jamison, "Precision Reloading," *Shooting Times*, Jun., 1996, pp. 28–33.

Howe, James Virgil, "The Modern Gunsmith," vol. II, New York 1937, pp. 119–120, 123–125, 128–129, 172.

Jamison, "Precision Reloading," *Shooting Times*, Sep., 1997, pp. 48–50, 52–54.

Barnes, ".378 Weatherby Magnum," *Cartridges of the World*, Chicago, 1965, p. 58.

"Principles and Practice of Loading Ammunition" by Earl Naramore, 1954, pp. 498 and 499.

.40–90 Bullard, *Cartridges of the World*, 1965, pp. 98 and 124.

. 50–95 Winchester, *Cartridges of the World*, 1965, pp. 116 and 124.

.450–348 Ackley, *Cartridges of the World*, 1965, pp. 140 and 143.

Howell, K.E., *Designing and Forming Custom Cartridges for Rifles and Handguns*, Feb. 9, 1995, pp. 405, 483 and 484.

"30 Howell," *Handbook for Shooters and Reloaders*, 1986, p. 428.

"Wade Super Seven," *Handbook for Shooters and Reloaders*, 1986, p. 396–397.

"7mm Express," *Handbook for Shooters and Reloaders*, 1986, pp. 397–398.

"8mm Express," *Handbook for Shooters and Reloaders*, 1986, pp. 455–456.

".375 Express," *Handbook for Shooters and Reloaders*, 1986, p. 482.

"Cartridge: 375 Express," *Handloader's Manual of Cartridge Conversion*, 1995 or earlier, p. 450.

".458 American," *Handbook for Shooters and Reloaders*, 1986, p. 499.

Barnes, ".425 Westley Richards Magnum," *Cartridges of the World*, 1965, pp. 225, 235.

Barnes, .284 Winchester, *Cartridges of the World*, 1965, p. 29.

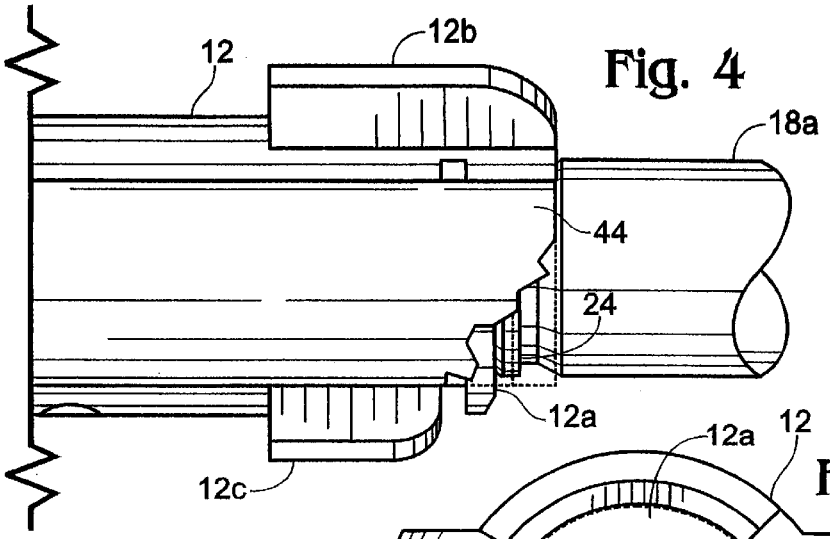
Fig. 4
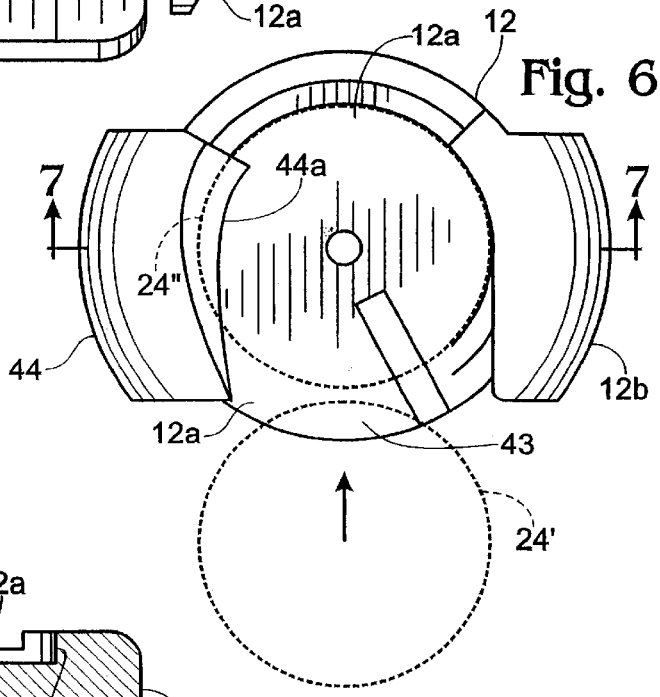
Fig. 6
Fig. 7
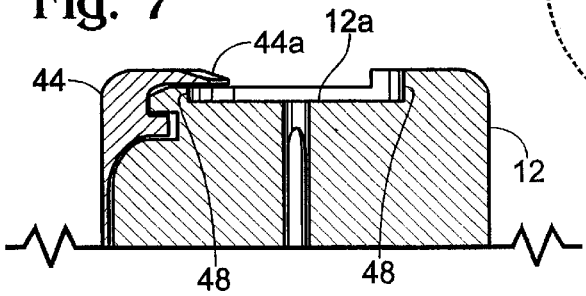
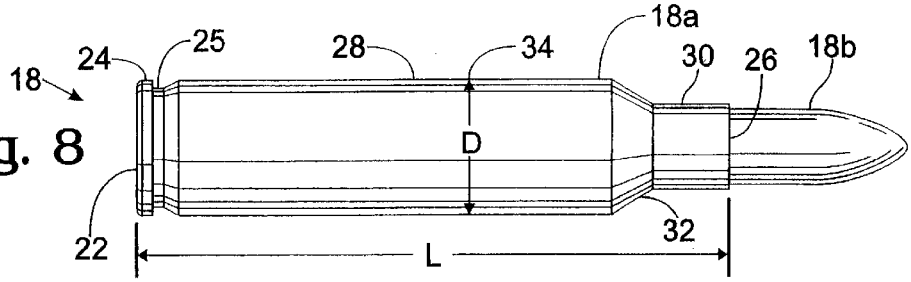
Fig. 8

ULTRA-SHORT-ACTION FIREARM FOR HIGH-POWER FIREARM CARTRIDGE

CROSS-REFERENCE TO RELATED APPLICATION

This application is a continuation of U.S. patent application Ser. No. 10/002,360, filed Nov. 13, 2001, now U.S. Pat. No. 6,550,174 which is a division of U.S. patent application Ser. No. 09/364,329 filed Jul. 29, 1999, now U.S. Pat. No. 6,354,221, which is a continuation of U.S. patent application Ser. No. 09/062,448 filed Apr. 17, 1998, now U.S. Pat. No. 5,970,879, which is a continuation-in-part of U.S. patent application Ser. No. 08/818,440 filed Mar. 17, 1997, now U.S. Pat. No. 5,826,361.

BACKGROUND OF THE INVENTION

The present invention is directed to a short-action firearm having a unique chamber and bolt assembly for firing a high-powered firearm cartridge. More particularly, the firearm chamber has pressure, length and diametric relationships, cooperative with those of a unique cartridge, enabling propellants to be burned more quickly and completely, thereby producing more energy and muzzle velocity for any given propellant capacity than is possible with most previous designs having the same propellant capacity.

In an article which I published in the January 1996 issue of *Shooting Times* magazine, I discussed the advantages of certain cartridges previously developed by Ackley, Mashburn, Palmisano and Pindell for improved velocity and accuracy. I also mentioned in the article that I had developed a high-power cartridge by modifying a 1908 Westley-Richards cartridge so as to have a unique, short, fat profile which could, for the first time, compatibly combine high velocity, accuracy and power with the compact, well-balanced and lightweight characteristics of a short-action firearm.

However, I had not at that time recognized the problem of permanent lengthwise cartridge case deformation caused by the severely-rebated, small-diameter rim and resultant large unsupported area of the rear wall of the much larger-diameter Westley-Richards cartridge case. Such cartridge case, when modified as described above to produce the propellant-burning characteristics and internal gas pressure curve profile discussed hereafter, proved incapable of withstanding internal gas pressures of at least about 50,000 psi without permanent rearward deformation of the unsupported area of the rear wall of the case, causing the bolt to bind within the extractor groove.

Also, at that time I had not recognized the importance of any specific maximum limit on the length-to-diameter ratio of a cartridge case necessary to produce the desired propellant-burning characteristics and internal gas pressure curve profile discussed hereafter.

BRIEF SUMMARY OF THE INVENTION

A short-action firearm has a chamber and bolt assembly with unique pressure, length and diametric relationships. The overall length of the chamber has a ratio to a diameter thereof, at a predetermined location on a wide portion of the chamber, of no more than about 3.5. Such diameter is at least about 0.53 inch, and the length of the wide portion of the chamber has a ratio to such diameter of no more than about 3.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 4 is a partially cutaway detail view of the portion of FIG. 3 indicated by the area 4.

FIG. 6 is an enlarged front view of the bolt face, with the rim of the top cartridge shown in dotted lines in two positions, the lower position corresponding to the rim's position in FIG. 5 and the upper position corresponding to its position in FIG. 5A.

FIG. 7 is a sectional bottom view taken along line 7—7 of FIG. 6.

FIG. 8 is a side view of an exemplary embodiment of a cartridge in accordance with the present invention.

DETAILED DESCRIPTION OF THE PREFERRED EMBODIMENT

Figure 1:
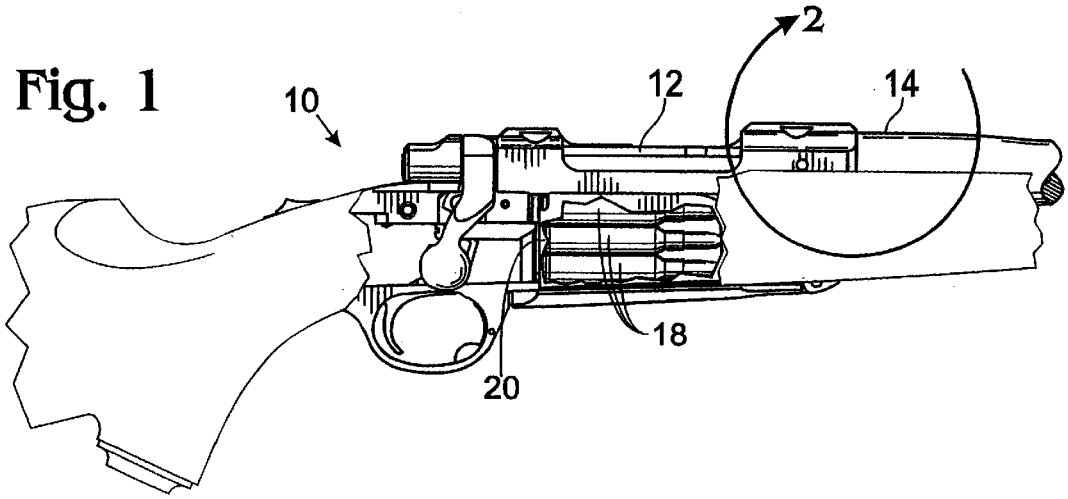
FIG. 1 is a partial side view of a rifle having a short bolt action and modified to incorporate the improvements of the present invention.

FIG. 1 depicts a short-action rifle modified in accordance with the present invention to be capable of employing short cartridges having high powder capacity, and thus high performance, despite the limitations which such short-action firearms place on cartridge length. By way of background, such limitations on cartridge length are due to the firearm's relatively short range of bolt motion between the bolt's fully retracted position and its fully extended, locked position. Such short-action firearms, although normally having reduced bullet velocity and power, nevertheless have the advantages of lower weight, more compactness, quicker feeding and better balance than do their longer action counterparts. However, when modified in accordance with the present invention, such short-action firearms can attain significantly higher performance comparable to that of their longer action counterparts. In fact, it has been discovered that short cartridges in accordance with the present invention can surprisingly even surpass the performance of long cartridges of the same powder capacity, due to quicker and more complete ignition of the powder in the short case.

It is to be understood that the scope of the present invention is not limited to rifles and their cartridges, but encompasses pistols and other types of firearms and their cartridges as well. Also, although the exemplary embodiment of the invention employs a staggered-column magazine, it could alternatively employ a single-column magazine.

The exemplary rifle 10, as modified in accordance with the present invention, includes a modified bolt assembly 12 and a barrel 14 modified to have a chamber 16 for matingly accepting a modified cartridge 18 in accordance with the present invention. Normally, existing conventional short-action staggered-column magazines such as 20 can be used compatibly with the present invention without modification.

Each cartridge 18 includes a cartridge case 18*a* and a bullet 18*b*. The caliber of the particular bullet 18*b* utilized in the cartridge is a matter of choice. For example, nominal bullet diameters of .224, .243, .257, .264, .277, .284, .308, .338, .358, .375, .416, and .458 are all practical for use in the high performance short cartridge of the present invention. For all calibers of bullet, the important characteristic is the proper proportioning of the cartridge case 18*a* to provide a short cartridge with a high performance.

With reference to FIG. 8, an exemplary cartridge 18 has an elongate tubular case 18*a* capable of withstanding internal gas pressures of at least about 50,000 psi. The case has a first end defining a substantially circular base 22 with an annular rim 24 protruding from a rim groove 25, and a second end defining a mouth 26 for insertably receiving the bullet 18*b*. A first substantially cylindrical case portion 28, and a second narrower substantially cylindrical case portion 30, are interconnected by a frusto-conical shoulder portion 32 extending at an angle of approximately 35° with respect to the axis of the cartridge. At least the wider case portion 28 is preferably not perfectly cylindrical, but rather is slightly frusto-conical, narrowing slightly in a direction away from the base 22. The overall length of the cartridge case 18, designated as L in FIG. 8, extends between the base 22 at the first end and the mouth 26 at the second end of the case. For purposes of the present invention, the outer diameter D of the wider portion 28 of the case 18*a* is measured at a location 34 which is 1.25 inches from the base 22, so as to identify such outer diameter precisely despite the slightly frusto-conical shape of the portion 28. In accordance with the present invention, in order to maximize the powder-carrying capacity of the case 18*a* in a manner which nevertheless produces a cartridge short enough to be used in a short-action firearm, the ratio of the overall case length L over such diameter D (i.e. L/D) should be no more than about 4.2. Preferably, case capacity (without the bullet) should be at least 50 grains of water when filled to its mouth.

By way of example, for higher caliber cartridges the length L could be about 2.2 inches and the diameter D could be between about 0.54 and 0.53 inch. In such case, the length of the portion 28 of the case as measured from the base 22 to the beginning of the frusto-conical portion 32, could be about 1.757 to 1.765 inches, or at least about 75% of the overall case length L. However increases in caliber would generally shorten the frusto-conical portion 32 and increase both the length and the diameter of the narrower cylindrical portion 30 to accommodate the insertion of larger caliber bullets into the mouth 26 of the case.

It is preferred that the cartridges of the present invention not have a radially protruding belt, such as on a belted magnum cartridge, on the outside of the case portion 28. One purpose of the short cartridges of the present invention is to maximize cartridge capacity for a short action. Adding a belt to the already larger diameter cartridge would require reductions in its diameter and capacity to make it compatible with a standard short action magazine. In addition, a belt would increase the difficulties attendant to chambering the cartridges.

The short, fat cartridges of the present invention increase the propellant burn efficiency and uniformity with the end result being higher muzzle velocity (with its attendant down-range advantages of reduced bullet drop, reduced wind deflection, and higher impact energy) and increased shot-to-shot pressure/velocity consistency offering the potential for improved accuracy. Smokeless propellants used in cartridges burn progressively, albeit very rapidly. In a firearm chamber, propellant burns over a period of time, producing increased pressure until it reaches a peak and then the pressure decreases until the bullet exits the muzzle wherein any remaining pressure does not contribute to bullet velocity. Cartridge performance is limited by a maximum allowable peak internal pressure in the chamber of the rifle.

The maximum L/D ratio of no more than about 4.2 for the cartridges of the present invention achieves greater burning efficiency in three different ways. First, the upper limit on the L/D ratio maximizes cartridge diameter which places more of the propellant in proximity to the initial flame front produced by the primer. Second, the maximized diameter provides increased surface area at the front of the wider case portion 28 where the portion 28 joins the frusto-conical shoulder portion 32, providing increased resistance to unburned powder granules as they are blasted forward and reflecting more unburned granules rearwardly into the burning propellant where they are consumed. (Minimal taper to the cartridge case for increased area at the front of the case and a relatively sharp case shoulder contribute to this propellant granule-retaining effect; however, shoulder angles of 40° or more relative to the cartridge axis are undesirable.) Third, the minimized cartridge length reduces the distance for the flame front to travel to ignite all the propellant. The more efficient ignition and combustion resulting from these three effects turns almost all of the granules into a gas before they come out of the case, producing more energy more quickly while reducing the unburned granule mass which must wastefully be accelerated together with the bullet.

Figure 10:
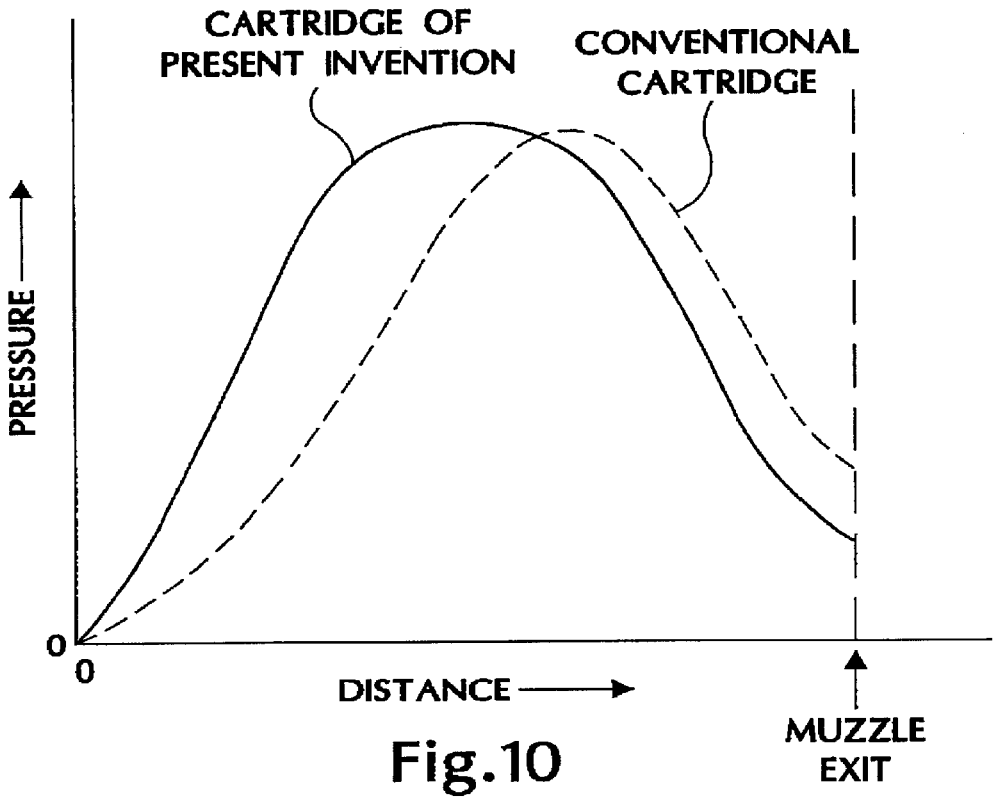
FIG. 10 illustrates exemplary pressure-distance curves comparing the performances of an exemplary embodiment of a cartridge in accordance with the present invention and a conventional longer cartridge having the same powder capacity.

FIG. 10 illustrates an exemplary comparison of the pressure curves for a shorter, wider cartridge of the present invention with a conventional cartridge of longer, narrower profile using the same quantity of powder and same bullet diameter. The vertical axis represents the pressure inside the chamber and barrel of a firearm while the horizontal axis measures the distance traveled by the bullet since the firing pin fall and primer detonation. The amount of energy imparted to a bullet by the cartridge is equal to the force imparted by the pressure of the escaping gas integrated over the distance the bullet travels in the firearm barrel. Thus, the areas under the pressure curves illustrated in FIG. 10 are good approximations of the amount of energy imparted to the bullet, and hence to the resulting velocity of the bullet upon exit from the muzzle of the firearm.

The pressure curves in FIG. 10 illustrate two advantageous results of the present invention. The more complete and quicker propellant ignition provided by the cartridge of the present invention produces a faster pressure rise time and more area under the pressure curve prior to the bullet exit. The area under the curve for a cartridge of the present invention is about 10% greater than the area for a conventional cartridge having the same propellant capacity. The increased area underneath the pressure curve illustrates the increased energy imparted to the bullet prior to muzzle exit. This translates into a higher bullet acceleration and muzzle velocity with the cartridge of the present invention over conventional cartridges. It also causes the peak pressure to be applied at an earlier, and thus thicker, portion of the barrel which tends to reduce adverse barrel distortion and thus promote accuracy, while also providing a greater barrel safety factor.

Also, the pressure curve in accordance with the present invention produces a lower pressure when the bullet exits the muzzle. A higher muzzle pressure adversely affects a bullet at the instant it leaves the muzzle. The velocity of the exiting gas is higher than the velocity of the exiting bullet. The escaping high velocity gases rushing past the bullet base have a tendency to tip the bullet and cause accuracy to deteriorate. Higher muzzle pressure also results in higher energy waste and undesirable increased recoil. FIG. 10 shows a greater pressure at muzzle exit for conventional cartridges as compared to cartridges of the present invention.

In addition, the powder granule retention effects of the cartridge of the present invention produce more efficient consumption and therefore also allow use of slower burning propellants. Slow burning propellants produce a flattened pressure curve having a greater total area under the pressure curve than faster burning propellants. Because the cartridges of the present invention can utilize slower burning propellants, the net result is that the area under the pressure curve can be increased significantly for higher muzzle velocity and energy and/or reduced muzzle pressure, noise and blast.

The powder retention effect of the cartridge of the present invention also has the added advantage of reduced throat erosion due to the fact that minimal high-velocity particles (powder granules) are being blasted into the throat of a firearm. A hot gas in combination with unburned powder granules are extremely erosive to a firearm barrel throat. The sharp shoulder and large diameter of the case contribute to improved powder retention in the case and reduced throat erosion.

Figure 9:
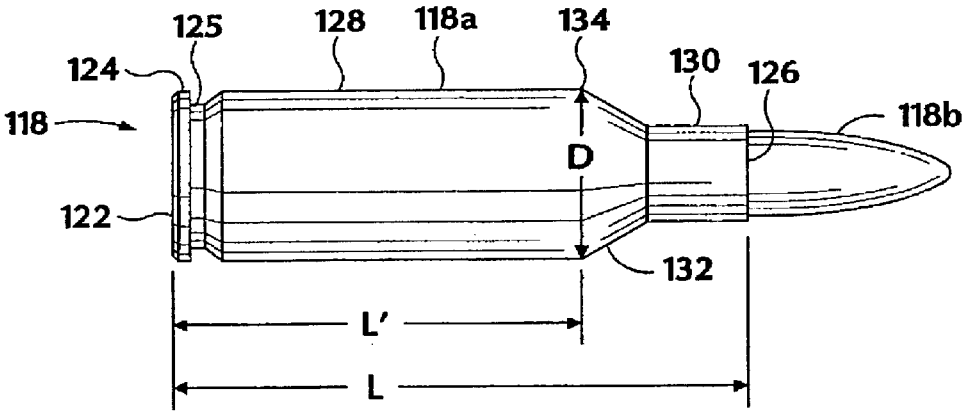
FIG. 9 is a side view of an alternative embodiment of a cartridge in accordance with the present invention.

FIG. 9 shows an alternative embodiment of a cartridge for use primarily with bullet diameters of .22 to .30 inch, but usable with larger calibers as well, with a shorter profile that takes even greater advantage of the benefits of a short cartridge with a wide diameter. These cartridges enable the use of firearms with even shorter actions. This further reduces the length of the firearm, further reduces the firearm weight, and provides for a shorter, faster bolt throw. For a .22 caliber bullet in particular, the cartridge offers higher performance than is currently obtainable.

FIG. 9 depicts an alternative embodiment 118 of the cartridge which, like the embodiment 18 depicted in FIG. 8, has the capability for providing a high performance cartridge for use with a short action rifle. With reference to FIG. 9, an exemplary cartridge 118 has an elongate tubular case 118*a* capable of withstanding internal gas pressures of at least about 50,000 psi. The case has a first end defining a substantially circular base 122 with an annular rim 124 protruding from a rim groove 125, and a second end defining a mouth 126 for insertably receiving the bullet 118*b*. A first substantially cylindrical case portion 128, and a second narrower substantially cylindrical case portion 130, are interconnected by a frusto-conical shoulder portion 132 extending at an angle preferably at least 300 but less than 400, and most preferably approximately 35°, with respect to the axis of the cartridge. At least the wider case portion 128 is preferably not perfectly cylindrical, but rather is slightly frusto-conical, narrowing slightly in a direction away from the base 122. The overall length of the cartridge case 118, designated as L in FIG. 9, extends between the base 122 at the first end and the mouth 126 at the second end of the case. For purposes of the present invention, an outer diameter D of the wider portion 128 of the case 118*a* is preferably measured at a location 134 which is 1.25 inches from the base 122, so as to identify such outer diameter precisely despite the slightly frusto-conical shape of the portion 128.

In accordance with the present invention, in order to maximize the powder-carrying capacity of the case 118*a* in a manner which nevertheless produces a cartridge short enough to be used in an extremely short-action firearm, the ratio of the overall case length L over such diameter D (i.e., L/D) should be no more than about 3.5. To maximize the powder retention and burn characteristics, the ratio of the length L' of the first portion 128 to the diameter of the first portion where the first portion 128 joins the shoulder 132 (preferably coincident with diameter D) should be no more than about 3, and preferably no more than about 2.5.

By way of example, for a .224 caliber cartridge the length L should be about 1.7 inches and the diameter D should be at least about 0.45 inch, and preferably 0.533 inch. The diameter of the rim 124 is preferably greater than 0.5 inch. The length L' of the portion 128 of the case as measured from the base 122 to the beginning of the frusto-conical portion 132, would be about 1.25 inches, and is preferably less than 1.5 inches. The ratio of the length of the first portion 128 to the diameter D is about 2.35. Increases in caliber would generally shorten the frusto-conical portion 132 and increase both the length and diameter of the narrow cylindrical portion 130 to accommodate the insertion of larger caliber bullets into the mouth 126 of the case.

The alternative embodiment results in increased bullet velocity over conventional cartridges having the same amount of propellant. For example, the alternative embodiment of the present invention illustrated in FIG. 9 can be compared with the standard .220 Swift cartridge, which is a longer cartridge taking a longer action. The .220 Swift cartridge has a shallower shoulder angle of 21°. Using H-414 propellant (one of the best for the Swift), the .220 Swift fires a 55-grain bullet at 3,685 feet-per-second (fps) with 57,900 per square inch peak chamber (psi) pressure. Using the same propellant and primer, the shorter embodiment of the present invention illustrated in FIG. 9 fires the same bullet at 4,045 fps with 56,300 psi peak chamber pressure.

The smaller alternative embodiment solves a problem of barrel erosion which is attendant to conventional small caliber cartridges. Retarding powder granules becomes particularly important in small calibers with relatively large cases due to the fact that the unburned granules have the effect of sandblasting the throat of a chamber, wearing it quickly. With conventional cartridges the effect becomes increasingly pronounced as bullet diameter is reduced because more unburned powder granules are blasted through a smaller hole. The alternative embodiment, however, actually improves powder consumption characteristics as bullet diameter is reduced. If a large wide portion 128 diameter is retained and the length of the cartridge is shortened to accommodate high performance with a smaller bullet diameter, the powder burning efficiency is improved. It is improved because the first portion 128 length-to-diameter ratio is shortened and there is proportionately greater surface area at the location where the front end of the first portion 128 meets the shoulder portion 132 to retain powder granules.

With the cartridge 18, and the shorter cartridge 118, of the present invention, there is ample case capacity for any shooting purpose. Only one wide portion diameter, one shoulder angle, and only two lengths for any caliber round are needed for hunting the smallest animal through the largest, or for any target or silhouette shooting purpose.

The cartridge of the present invention can also be used for mid-diameter bullets such as the .284 or .308 caliber. A shooter can have a high performance magnum class round with the cartridge 18, or with the smaller cartridge 118 have an efficient, low recoil, pleasant to shoot round. The latter, due to its efficiency, is still enough for any game in North America.

Figure 2:
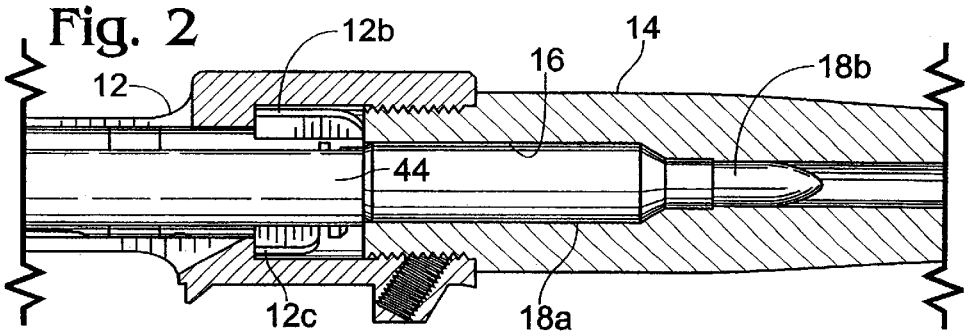
FIG. 2 is an enlarged sectional view of the chamber portion of the rifle of FIG. 1, indicated by the area 2 of FIG. 1, showing a cartridge fully locked within the chamber by the bolt.
Figure 2A:
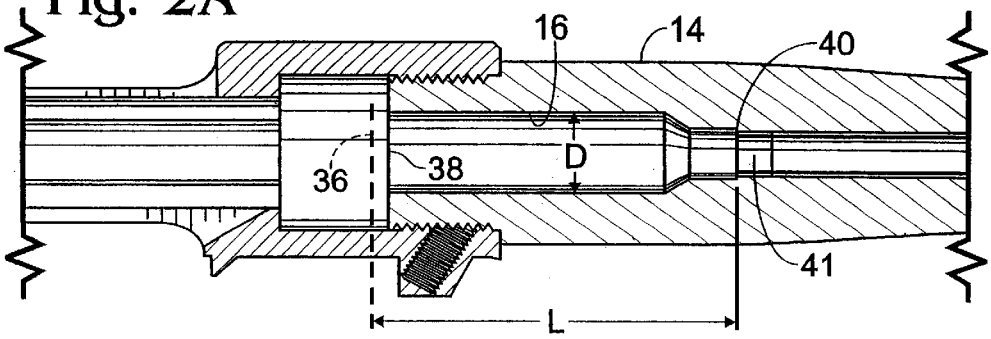
FIG. 2A is a view similar to that of FIG. 2, with the cartridge and bolt withdrawn.
Figure 3:
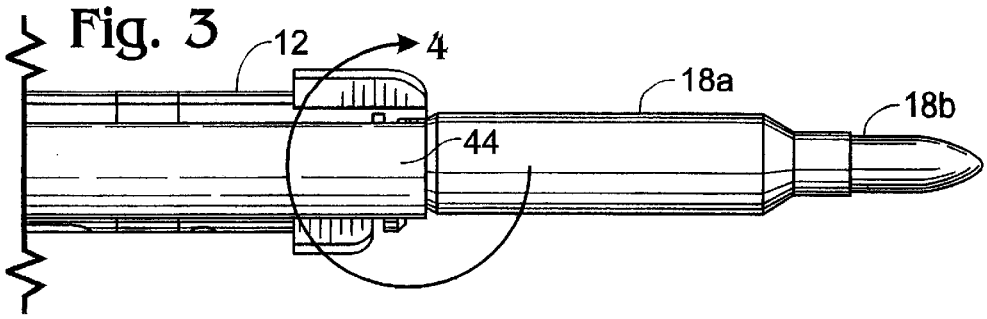
FIG. 3 is an enlarged side view of the locked bolt and cartridge of FIG. 2.

With reference to FIG. 2A, the modified barrel 14 has a chamber 16, capable of withstanding internal gas pressures of at least about 65,000 psi, with substantially mating proportions to those of the cartridge and with about .002–.003 inch larger diametric dimensions to matingly receive the cartridge. For the chamber 16, the length dimension L is measured from the locked bolt face position 36 as shown in FIG. 2A (which corresponds to the position of the base 22 of the cartridge 18 when the bolt assembly 12 is locked). The chamber 16 has a first end 38 which may either be offset from the locked bolt face position 36 as shown, or coincident therewith depending upon the design of the firearm. A second end 40 of the chamber 16 defines a case mouth recess for the cartridge case. Preferably a short throat area 41 of slightly forwardly-tapered frusto-conical shape (for example with a cone angle of approximately 1½° for smaller calibers and approximately 2½° for larger calibers) extends forwardly of the second end 40 of the chamber 16 to provide a smooth bullet-engraving transition.

Figure 5:
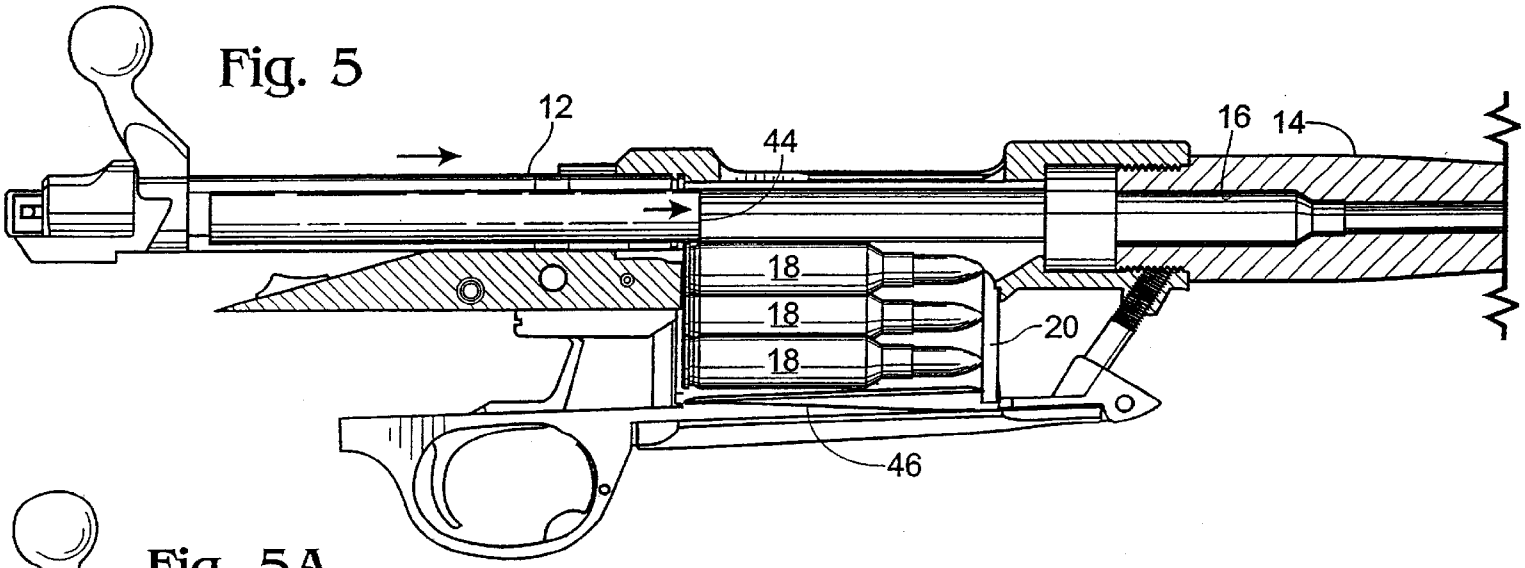
FIG. 5 is an enlarged side sectional view of the bolt, chamber and magazine assembly of the rifle of FIG. 1, with the bolt shown commencing its forward motion to feed the top cartridge.

Ensuring smooth feeding and chambering of the short, fat, sharply-shouldered cartridges of the present invention is accomplished in two different ways. First, the outer diameter of the rim 24 or 124 at the base of the cartridge 18 or 118 is substantially no less than the outer case diameter D measured at the location 34 (FIG. 8) or 134 (FIG. 9). Such a wide, or unrebated, base rim 24 or 124, as mentioned previously, prevents permanent lengthwise deformation of the cartridge under the propellant-burning characteristics and pressure curve profile described above. Such unrebated rim also maximizes the rearwardly-facing surface of the cartridge 18 which is initially engageable by the bolt face 12*a* of the bolt assembly 12 to push the top cartridge forward as the bolt begins its forward feeding movement from its fully retracted position, as shown in FIG. 5. FIG. 6 shows this same initial engagement position of the bolt face 12*a* with respect to the position 24' of the rim 24 of the top cartridge 18, while the cartridge is still retained within the magazine 20. FIG. 6 also illustrates the importance of maximizing the outer diameter of the rim 24 to create a sufficient vertical overlap area 43 with the bolt face 12*a* in light of the top cartridge's relatively low position of retention, due to its profile, in the magazine 20 prior to being engaged by the bolt face 12*a*. Such vertical overlap area 43 is needed so that the bolt face 12*a* can reliably engage the base of the top cartridge 18 to push it forward and out of retention by the magazine 20.

Figure 5A:
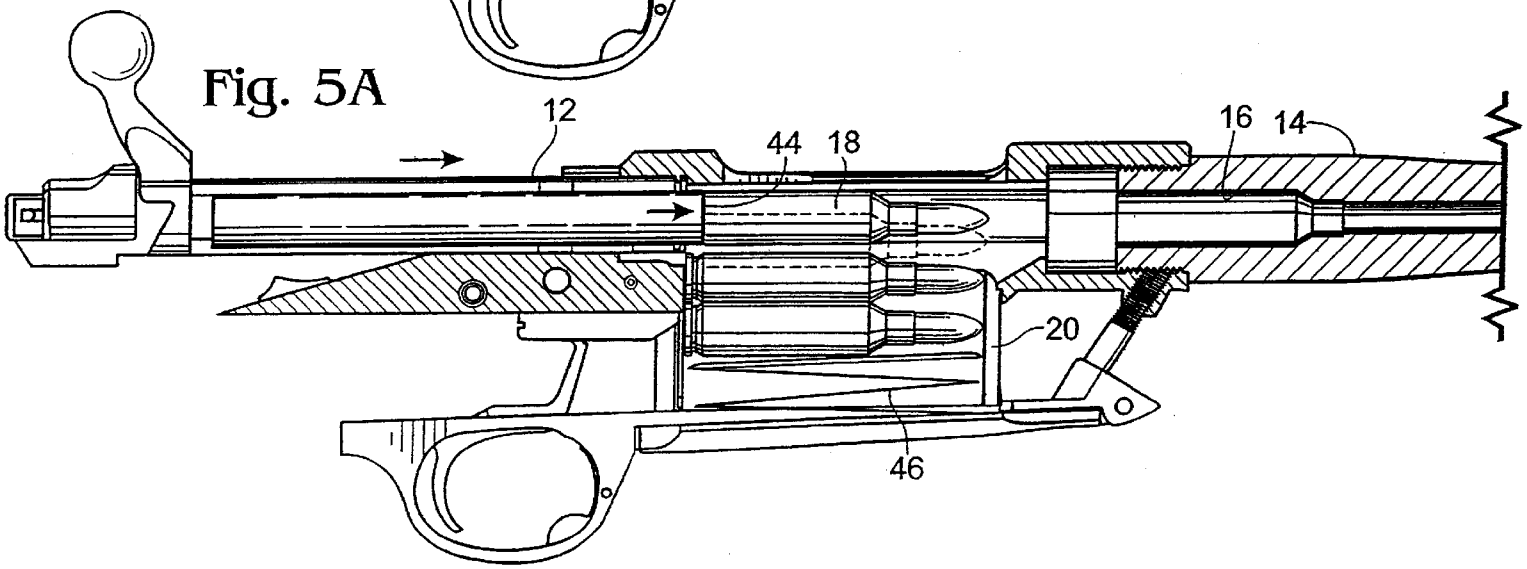
FIG. 5A is a view similar to that of FIG. 5, with the bolt advanced further forwardly to a position where the magazine spring has pushed the cartridges upwardly so that the rim of the top cartridge has moved transversely to the bolt face to a position where it is gripped between the extractor and the bolt face.

The second feature of the present invention which ensures smooth feeding and chambering of the cartridges, despite their unusual profiles, is a modification of the bolt face 12*a* relative to the extractor 44. As the bolt assembly 12 slides forward from its position shown in FIG. 5, the top cartridge 18 is released by the magazine so that the magazine spring 46 can push it upwardly through an intermediate position shown in dotted lines in FIG. 5A to the fully elevated position shown in FIG. 5A. In making this transition, the rim 24 of the top cartridge moves upwardly, transversely to the bolt face 12*a*, from the position 24' to the position 24" shown in dotted lines in FIG. 6. The bolt face 12*a* is modified from a "closed" to an "open" configuration to provide an open-bottomed channel 48 (FIG. 7) between the bolt face 12*a* and lip 44*a* of the extractor 44, wide enough to accept the rim 24 so that the extractor grips the rim 24 between the extractor lip 44*a* and the bolt face 12*a* as shown in FIG. 6 as the cartridge moves upwardly. This enables the extractor 44 to grip the cartridge firmly in its proper alignment for chambering, as shown in FIG. 5A, before the cartridge begins to enter the chamber 16 so that the unique profile of the cartridge has no opportunity to interfere with its smooth entry into the chamber. After chambering, the bolt assembly is rotated in the normal manner so that the locking lugs 12*b* and 12*c* are oriented vertically, as shown in FIG. 2, to lock the bolt face 12*a* in its locked position 36.

Alternatively, the use of wider, staggered-column magazines, or single-column magazines, to accommodate the wider cartridges of the present invention would enable the use of more conventional "closed" bolt faces, if desired, which push the cartridge loosely into the chamber and grip it upon chambering.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A short-action firearm having an elongate chamber and bolt assembly comprising a tubular chamber and a bolt, selectively slidable longitudinally in a sliding direction between a retracted unlocked position and an extended locked position, said bolt providing a locked bolt face when said bolt is in said locked position, said chamber having a first end adjacent to said locked bolt face and a second end defined by a case mouth recess sized for operably receiving a cartridge with a projectile said chamber being capable of withstanding internal gas pressures of at least about 65,000 psi and being sized to matingly engage said cartridge so as to enable said cartridge to fire in said chamber with sufficient propellant to produce an internal gas pressure of at least 50,000 psi and to operably withstand said pressure, said bolt being capable of inserting said cartridge into said chamber and operably extracting said cartridge manually therefrom after firing of said cartridge at said pressure, said chamber having a first portion of substantially cylindrical shape adjacent to said first end and a second portion of a narrower substantially cylindrical shape adjacent to said second end, and a frusto-conical shoulder portion interconnecting said first portion and said second portion, said chamber having an overall length measured from said locked bolt face to said second end of said chamber, said first portion having a first portion inner diameter of at least about 0.53 inch at a location where said first portion interconnects with said shoulder portion, said overall length having a ratio to said first portion inner diameter at said location of no more than about 3.5, said first portion having a first portion length extending between said locked bolt face and said frusto-conical shoulder portion, said first portion length having a ratio to said first portion inner diameter at said location of no more than about 3, said chamber being sized for operably receiving a cartridge free of any protrusion on said cartridge extending radially outwardly beyond said cylindrical shape of said first portion of said chamber.

2. The firearm of claim 1, said frusto-conical shoulder portion extending at an angle of less than 40° with respect to a longitudinal axis of said chamber.

3. The firearm of claim 2, said shoulder portion extending at an angle of at least 30° with respect to said longitudinal axis.

4. The firearm of claim 1, said frusto-conical shoulder portion extending at an angle of about 35° with respect to a longitudinal axis of said chamber.

5. The firearm of claim 1 wherein said first portion length is less than 1.5 inch.

6. The firearm of claim 1 wherein said first portion length has a ratio to said first portion inner diameter of no more than about 2.5.

7. The firearm of claim 1 wherein said bolt has an extractor sized for operably gripping a rim portion of said cartridge having an outer rim diameter greater than 0.5 inch.

8. The firearm of any one of claim 1, said case mouth recess being sized for operably receiving a cartridge with a projectile of a specific diameter within a range from 0.22 to 0.30 inch.

9. The firearm of any one of claims 1–8, including said cartridge cooperatively engaged with said chamber for firing.

10. The firearm of any one of claims 1–8 wherein said bolt has an extractor sized for operably gripping a rim portion of said cartridge having an outside diameter substantially no less than said first portion inner diameter at said location so as to insure reliable bolt operation of said firearm.

11. The firearm of any one of claims 1–8 wherein said bolt has an extractor adjacent to said bolt face, and a channel oriented transversely to said sliding direction of said bolt through which a rim portion of said cartridge is movable transversely to said sliding direction into gripping engagement by said extractor before said cartridge is inserted into said chamber.

12. A short-action firearm having an elongate chamber and bolt assembly comprising a tubular chamber and a bolt, selectively slidable longitudinally in a sliding direction between a retracted unlocked position and an extended locked position, said bolt providing a locked bolt face when said bolt is in said locked position, said chamber having a first end adjacent to said locked bolt face and a second end defined by a case mouth recess sized for operably receiving a cartridge with a projectile, said chamber being capable of withstanding internal gas pressures of at least about 65,000 psi and being sized to matingly engage said cartridge so as to enable said cartridge to fire in said chamber with sufficient propellant to produce an internal gas pressure of at least 50,000 psi and to operably withstand said pressure, said bolt being capable of inserting said cartridge into said chamber and operably extracting said cartridge manually therefrom after firing of said cartridge at said pressure, said chamber having a first portion of substantially cylindrical shape adjacent to said first end and a second portion of a narrower substantially cylindrical shape adjacent to said second end, and a frusto-conical shoulder portion interconnecting said first portion and said second portion, said chamber having an overall length measured from said locked bolt face to said second end of said chamber, said first portion having a first portion inner diameter at a location where said first portion interconnects with said shoulder portion, said overall length having a ratio to said first portion inner diameter at said location of no more than about 3.5, said first portion having a first portion length extending between said locked bolt face and said frusto-conical shoulder portion, said first portion length having a ratio to said first portion inner diameter at said location of no more than about 3, said bolt having an extractor sized for operably gripping a rim portion of said cartridge having an outer rim diameter greater than 0.5 inch, said chamber being sized for operably receiving a cartridge free of any protrusion on said cartridge extending radially outwardly beyond said cylindrical shape of said first portion of said chamber.

13. The firearm of claim 12, said frusto-conicsal shoulder portion extending at an angle of less than 40°with respect to a longitudinal axis of said chamber.

14. The firearm of claim 13, said shoulder portion extending at an angle of at least 30° with respect to said longitudinal axis.

15. The firearm of claim 12, said frusto-conical shoulder portion extending at an angle of about 35° with respect to a longitudinal axis of said chamber.

16. The firearm of claim 12 wherein said first portion length is less than 1.5 inch.

17. The firearm of claim 12 wherein said first portion length has a ratio to said first portion inner diameter of no more than about 2.5.

18. The firearm of claim 12, said case mouth recess being sized for operably receiving a cartridge with a projectile of a specific diameter within a range from 0.22 to 0.30 inch.

19. The firearm of any one of claims 12–18, including said cartridge cooperatively engaged with said chamber for firing.

20. The firearm of any one of claims 12–18 wherein said bolt has an extractor sized for operably gripping a rim portion of said cartridge having an outside diameter substantially no less than said first portion inner diameter at said location so as to insure reliable bolt operation of said firearm.

21. The firearm of any one of claims 12–18 wherein said bolt has an extractor adjacent to said bolt face, and a channel oriented transversely to said sliding direction of said bolt through which a rim portion of said cartridge is movable transversely to said sliding direction into gripping engagement by said extractor before said cartridge is inserted into said chamber.

* * * * *

UNITED STATES PATENT AND TRADEMARK OFFICE

CERTIFICATE OF CORRECTION

PATENT NO. : 6,678,983 B2
DATED : January 20, 2004
INVENTOR(S) : John R. Jamison It is certified that error appears in the above-identified patent and that said Letters Patent is hereby corrected as shown below:

Column 6,
Line 2, change "300" to -- 30º --.
Line 3, change "400," to -- 40º, --.

Column 8,
Line 47, change "projectile" to -- projectile, --.

Column 9,
Line 25, delete "any one of".

Column 10,
Line 24, change "frusto-conicsal" to -- frusto-conical --.

Signed and Sealed this

Sixteenth Day of March, 2004

JON W. DUDAS
*Acting Director of the United States Patent and Trademark Office*